US006720918B2

(12) United States Patent
Reckdahl et al.

(10) Patent No.: US 6,720,918 B2
(45) Date of Patent: Apr. 13, 2004

(54) ANTENNA DISTORTION ESTIMATION AND COMPENSATION

(75) Inventors: Keith Reckdahl, Palo Alto, CA (US); Lawrence McGovern, Mountain View, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 10/244,944

(22) Filed: Sep. 17, 2002

(65) Prior Publication Data

US 2004/0051662 A1 Mar. 18, 2004

(51) Int. Cl.[7] ..... H04B 7/185
(52) U.S. Cl. ..... 342/358; 342/354
(58) Field of Search ..... 342/358, 359, 342/354; 701/222

(56) References Cited

U.S. PATENT DOCUMENTS 5,852,792 A * 12/1998 Nielson ..... 701/222
6,320,538 B1 * 11/2001 Lalezari et al. ..... 342/371

OTHER PUBLICATIONS

Acosta, R.J. et al, "System Overview on Electromagnetic Compensation for Reflector Antenna Surface Distortion," Digest Antennas and Propagation Society International Symposium, Jul. 1993, pp. 258–261.*
Rahmat–Samii, Y. "Reflector Antenna Distortion Compensation by Array Feeds: An Experimental Verification," Electronic Letters, vol. 24, No. 18, Sep. 1988, pp. 1188–1190.*
Kim, David Y. et al, "Thermal Distortion Analysis on ACTS Multibeam Antenna," Digest Antennas and Propagation Society International Symposium, Jun. 1988, pp. 1310–1313, vol. 3.*

* cited by examiner

*Primary Examiner*—Gregory C. Issing
(74) *Attorney, Agent, or Firm*—Karambelas & Associates

(57) ABSTRACT

A thermal distortion estimation system for delivering thermal time varying distortion of various spacecraft antenna is provided which includes a measurement signal outage indicator and a storage device containing time varying distortion data. A signal is generated indicating an outage for the system received by the spacecraft and then a generated time varying distortion of the system from a previous measurement history to predict the error resulting from the thermal distortion is employed to estimate the error.

11 Claims, 4 Drawing Sheets

(con't)

ANTENNA DISTORTION ESTIMATION AND COMPENSATION

BACKGROUND

I. FIELD OF INVENTION

Figure 1:
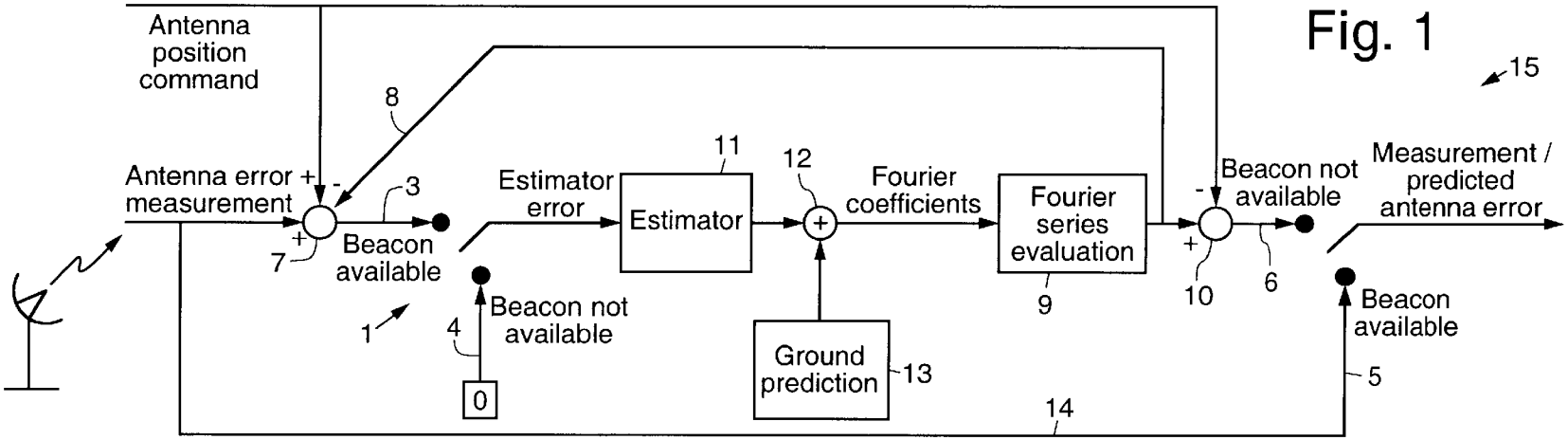

This invention relates to satellite communications and more specifically to estimating the thermal distortion of antennas on said spacecraft in order to ultimately compensate for the thermal distortion resulting in improved communications.

II. PRIOR ART

The prior art senses distortion (thermal and other) on the antenna of a spacecraft and compensates for the distortion so as to keep the beam properly positioned, e.g., various systems sample the distortion in real time periodically and compensate for same accordingly (up to 64 times/sec.) Problems are encountered with prior art systems e.g., when there are cloudy configurations or rain, the ground beam energy fades or does not transmit effectively to the spacecraft. The failure to transmit or sense results in the inability to correct at all.

In general, it is conventional to sense distortion relating to thermal and other disturbances or perturbations on the antenna of a spacecraft in order to measure same and ultimately compensate for the distortion so as to keep the beam properly positioned. Typically this may be done by employing a system which is continuously operated to sample either in real time or periodically to determine the distortion and then correct same. However, although these estimations and corrections may result in acceptable-to-excellent results, problems occur when there are outages or the absence of reliable data due to cloudy conditions, rain or other atmospherics causing the ground beam energy to fade or to reduce transmission effectively and/or terminate said transmission to the spacecraft.

In U.S. Pat. No. 5,940,034 there is described a system and method for RF autotracking multiple antennas to compensate for disturbances experienced by the antennas. The system and method uses two control algorithms implemented in fast and slow controllers and sums the results for each antenna that is tracked. Combinations and permutations of prior art have been implemented to provide redundancy in order to eliminate outages.

The prior art does not appear to appreciate nor resolve the problem of outages with regard to autotrack applications, i.e., non-fixed antenna systems.

III. OBJECTS OF INVENTION

It is, therefore, an object of this invention to provide a novel antenna distortion estimation and compensation system which overcomes the deficiencies of the prior art.

Another object is to provide a novel thermal compensation system. Still another object is to reduce dependency on ground beams. Yet another object of the invention is to provide a system which overcomes the solution inaccuracies present in the prior art with regard to these outages.

It is a further object of this invention to provide an antenna distortion estimation system that is unique and provides for proper pointing when outages occur.

A further object of this invention is to employ one beacon in an antenna distortion estimation system to provide proper pointing.

IV. SUMMARY OF THE INVENTION

These and other objects of the instant invention are accomplished generally speaking by providing a thermal distortion estimation system for delivering thermal time varying distortion of various spacecraft antenna comprising:

A system for estimating the thermal time varying distortion of spacecraft antenna is provided comprising a measurement signal outage indicator and a storage device which contains time varying distortion data.

The system of the instant invention generates a signal that determines an outage for the system received by the spacecraft and employs a generated time varying distortion of the system from a previous measurement history to predict the error resulting from the thermal distortion.

Any suitable method to determine signal outage for the system may be employed in the system of the instant invention. Typical sensors include a tracking receiver that measures the output of the automatic gain control loop.

Typical outage sensors would include those that measure the magnitude of the signal, and determine the position error to detect an outage. In other words, however the error position is sensed, it may also be used with appropriate processing to determine the presence of an outage.

In the general case, the thermal distortion estimation system of the instant invention would include an indicator which detects signal outage and a storage device which contains time varying distortion data. In a preferable embodiment of the instant invention the system may be mathematically defined or expressed as a Fourier Series from which the constants are determined by empirical data and optimally from historical thermal distortion data with a concentration of the data most closely corresponding in time to the outage.

V. BRIEF DESCRIPTION OF THE DRAWINGS

In FIG. 1, there is seen an antenna distortion estimator block diagram.

Figure 2:
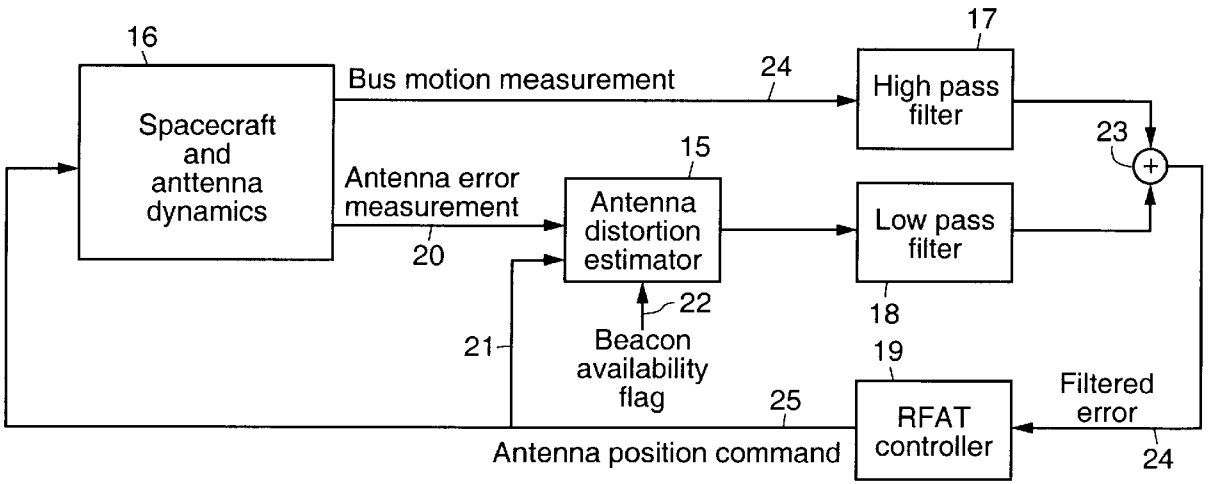

In FIG. 2, there is seen a closed loop system of such a system.

Figure 3:
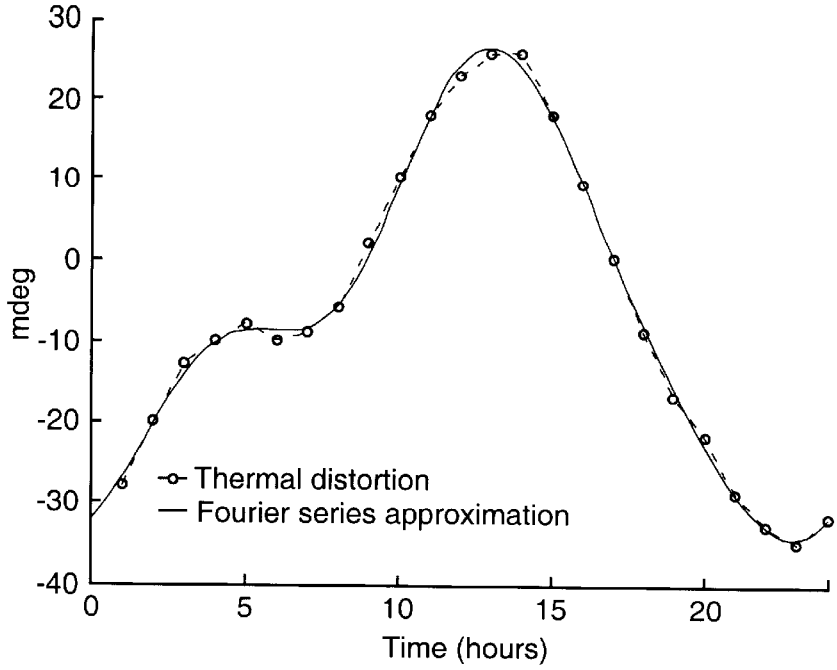

In FIG. 3, is seen a typical antenna thermal distortion and approximation with third-order Fourier Series.

Figure 4:
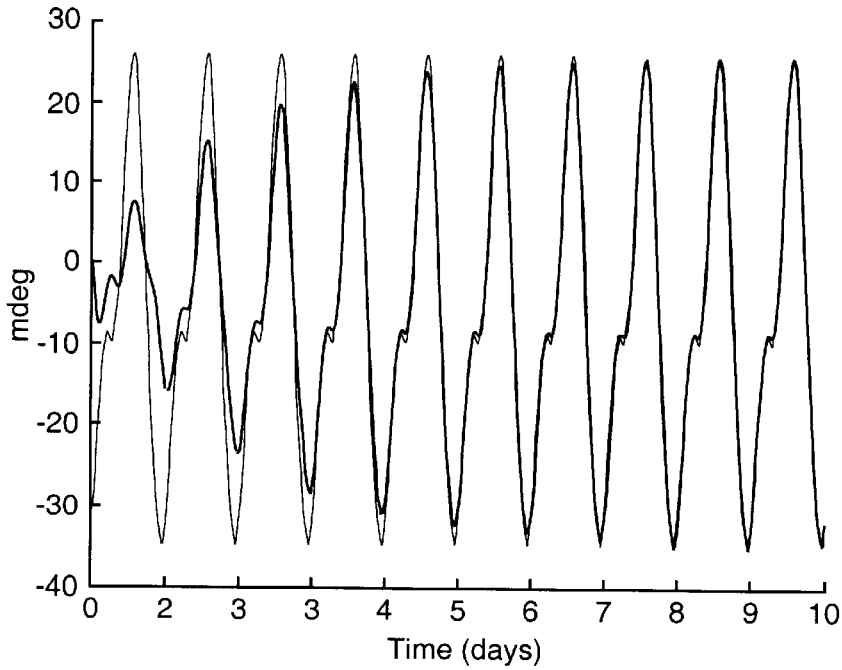

In FIG. 4, there is depicted a convergence of thermal distortion estimate graph.

Figure 5:
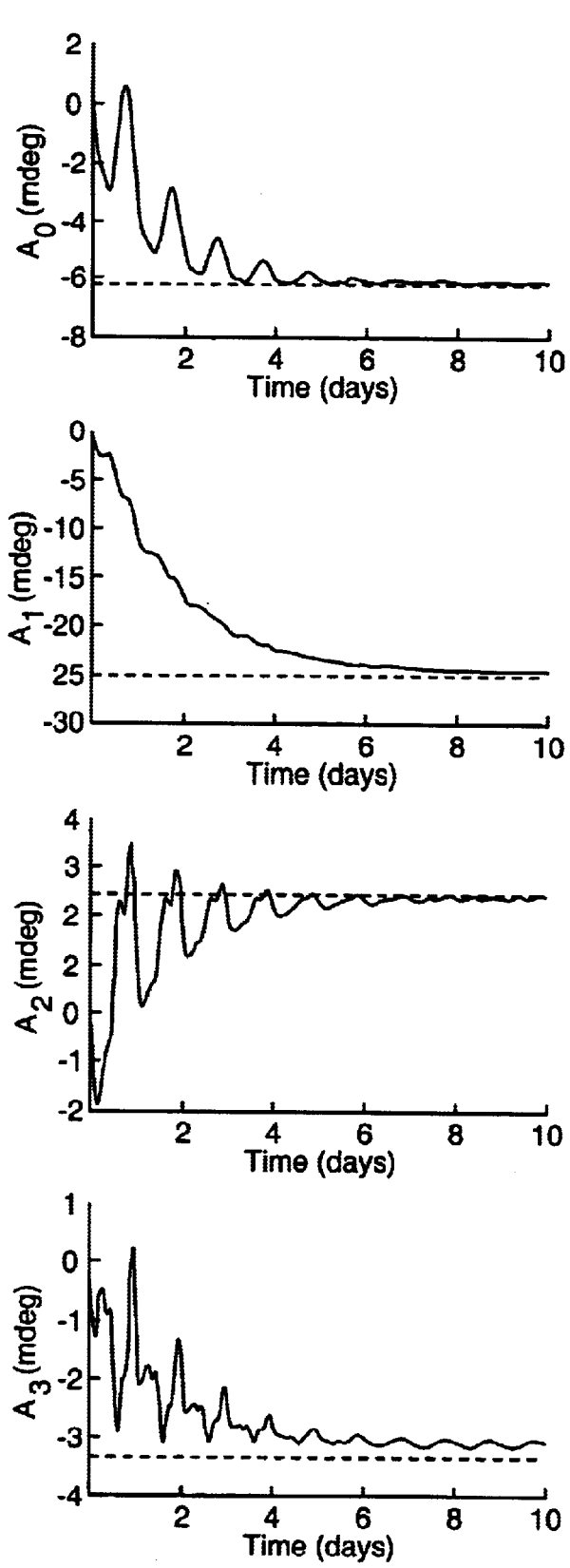
Figure 5:
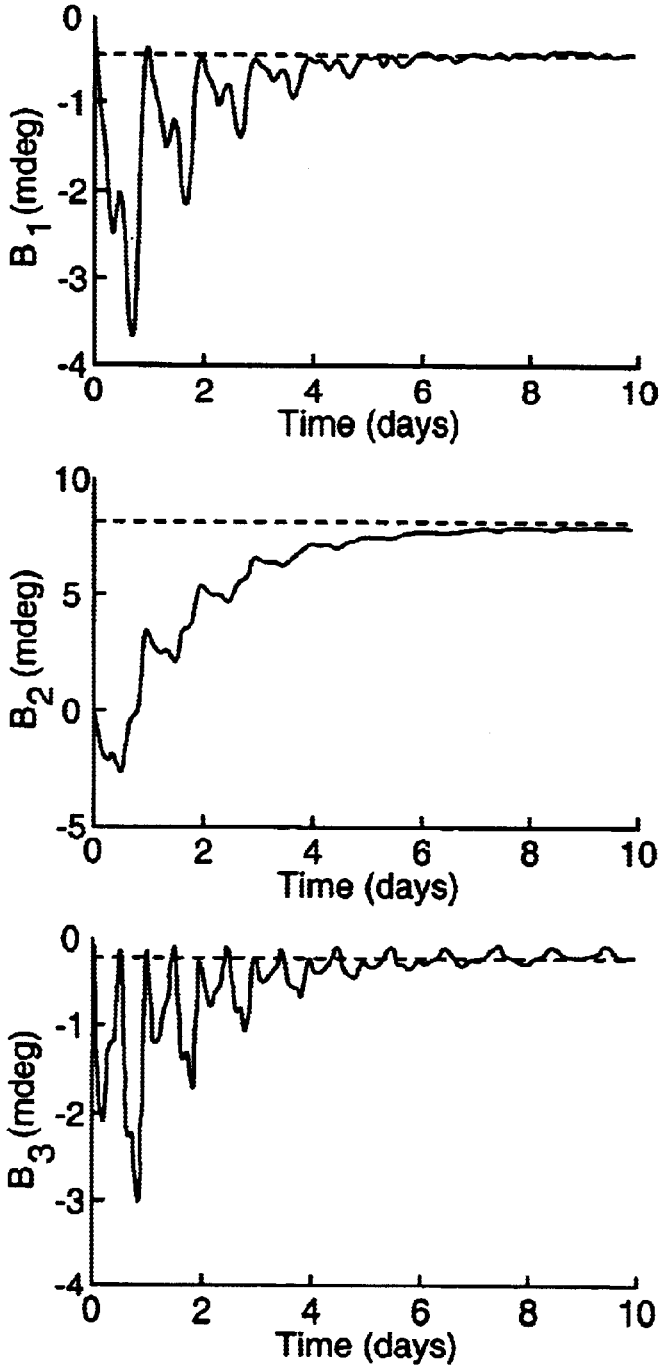

In FIG. 5 there is shown the convergence of the Fourier coefficients states.

VI. DETAILED DESCRIPTION (DRAWINGS)

FIG. 1 shows an antenna distortion estimator block diagram. This estimator requires the antenna position command and two inputs derived from the beacon signal: a flag indicating the availability of the beacon, and an RF sensor measurement of the beam error, valid only when the beacon is available. The beacon availability flag controls two switches. The first switch controls the estimator input, transmitting the estimator error when beacon measurements are available, and zero otherwise. The second switch controls the system output, directly transmitting the RF sensor measurement when the beacon is available, and transmitting the estimated thermal distortion minus the antenna position command when the beacon is not available.

The estimator also includes a set of ground predictions. These predictions must be based on a long history of antenna distortion data, meaning the spacecraft must be in operation for a designated period of time before these predictions may be implemented. Although the ground predictions are not a necessary element of the thermal distortion estimator, they may be useful if extended beacon outages are expected.

FIG. 2 shows a simplified block diagram of the closed-loop system. This estimator is to be embedded in the RFAT topology. In the current topology, several antennas share a single RFAT receiver. Due to this sharing, the RFAT receiver is only able to provide low-frequency error measurements. This low frequency signal is combined with a high frequency "bus motion" measurement through a pair of complementary low and high pass filters. Measurement of the bus motion may come from a dedicated antenna/RFAT receiver or from the spacecraft bus's attitude sensors.

In FIG. 3 shows that while the exact thermal distortion profile is hard to accurately predict, it is known to be periodic with the dominant spectral content at the first several harmonics of orbit rate (i.e., $\omega_0, 2\omega_0, \ldots, N\omega_0$). Due to its periodicity, the thermal distortion profile can be approximated by a Fourier series. FIG. 3 shows an example thermal profile, approximated by a third-order Fourier series.

Although this profile is fairly repeatable from day to day, it does slowly change from season to season. Therefore, a Fourier series with slowly time-varying coefficients is an appropriate model, i.e., $$T(t) = A_0(t) + \sum_{n=1}^{N} A_n(t)\cos\omega_o t + \sum_{n=1}^{N} B_n(t)\sin\omega_o t.$$

The estimator is designed to estimate the time-varying coefficients $A_0(t), \ldots, A_N(t)$ and $B_0(t), \ldots, B_N(t)$ similar to the invention described in pending U.S. patent application Ser. No. 10/087,279 titled Satellite Harmonic Torque Estimator filed Mar. 1, 2002 having a common assignees of McGovern and Price.

The estimator is designed using linear estimation theory. An Nth-order periodic signal y(t) can be modeled as the steady-state response of the following linear system due to an initial condition $\epsilon$:

$$\dot{x}=Ax,\ x(0)=\epsilon y(t)=Cx(t)$$

where $$A = \begin{bmatrix} 0 & & & & & & & \\ & 0 & \omega_0 & & & & & \\ & -\omega_0 & 0 & & & & & \\ & & & 0 & 2\omega_0 & & & \\ & & & -2\omega_0 & 0 & & & \\ & & & & & \ddots & & \\ & & & & & & 0 & N\omega_0 \\ & & & & & & -N\omega_0 & 0 \end{bmatrix}$$

$$C = [1\ 1\ 0\ 1\ 0\ \ldots\ 1\ 0].$$

An estimator gain matrix can be derived by $$L=PC^T$$

Where P is the symmetric, positive semi-definite solution to the standard to the standard Ricatti equation:

$$AP+PA^T-PC^TCP+Q=0$$

and Q is a weighting matrix. This gain matrix derivation is a standard result from linear quadratic estimation theory, and is found in most linear estimation textbooks. The matrix Q is a design parameter, and its choice affects the speed of the estimator. For example, the choice $Q=I\times10^{-10}$ results in the gain matrix $$L - \begin{bmatrix} 1.0000\times10^{-5} \\ 1.4080\times10^{-5} \\ 1.3281\times10^{-6} \\ 1.4000\times10^{-6} \\ 1.9988\times10^{-6} \\ 1.3713\times10^{-5} \\ 3.4559\times10^{-6} \end{bmatrix}^T$$

with estimator time constants on the order of a day. The state-space representation of the estimator is $$\dot{x}=Ax+L(y_{meas}-y_{est})$$

$$y_{est}=C_x$$

Ultimately, the objective is to estimate the Fourier coefficients of $y_{meas}$. Fortunately, there is a simple transformation from the linear estimator above to a Fourier coefficient estimator. To illustrate, consider the linear estimator $$\frac{d}{dt}\begin{bmatrix} x \\ x^* \end{bmatrix} = \begin{bmatrix} 0 & \omega_0 \\ -\omega_0 & 0 \end{bmatrix}\begin{bmatrix} x \\ x^* \end{bmatrix} + L(y_{meas} - y_{est}).$$

Writing the Fourier series representation of the states as $$x=A(t)\cos\omega_0 t+B(t)\sin\omega_0 t$$

$$x^*=-A(t)\sin\omega_0 t+B(t)\cos\omega_0 t$$

Then the estimator equation (4) becomes $$\frac{d}{dt}\begin{bmatrix} x \\ x^* \end{bmatrix} = \begin{bmatrix} \cos\omega_0 t & \sin\omega_0 t \\ -\sin\omega_0 t & \cos\omega_0 t \end{bmatrix}\begin{bmatrix} \dot{A} \\ \dot{B} \end{bmatrix} + \begin{bmatrix} 0 & \omega_0 \\ -\omega_0 & 0 \end{bmatrix}\begin{bmatrix} T \\ T^* \end{bmatrix}$$

$$= \begin{bmatrix} 0 & \omega_0 \\ -\omega_0 & 0 \end{bmatrix}\begin{bmatrix} x \\ x^* \end{bmatrix} + L(y_{meas} - y_{est})$$

therefore $$\begin{bmatrix} \cos\omega_0 t & \sin\omega_0 t \\ -\sin\omega_0 t & \cos\omega_0 t \end{bmatrix}\begin{bmatrix} \dot{A} \\ \dot{B} \end{bmatrix} = L(y_{meas} - y_{est}).$$

Using the property $$\begin{bmatrix} \cos\omega_0 t & \sin\omega_0 t \\ -\sin\omega_0 t & \cos\omega_0 t \end{bmatrix}^{-1} = \begin{bmatrix} \cos\omega_0 t & -\sin\omega_0 t \\ \sin\omega_0 t & \cos\omega_0 t \end{bmatrix},$$

then $$\begin{bmatrix} \dot{A} \\ \dot{B} \end{bmatrix} = \begin{bmatrix} \cos\omega_0 t & -\sin\omega_0 t \\ \sin\omega_0 t & \cos\omega_0 t \end{bmatrix} L(y_{meas} - y_{est}).$$

Therefore, the nonlinear system (5) is entirely equivalent to (4), and the new states are the Fourier coefficients.

The extension of this transformation to the full vector of Fourier coefficients is $$\dot{c}=F(t)L(y_{meas}-y_{est}) \quad (6)$$

$$y_{est}=G(t)c$$

where $$c^T=[A_0\ A_1\ B_1\ A_2\ B_2\ \ldots\ A_N\ B_N],$$

$$F(t)=\begin{bmatrix} 1 & & & & & & \\ & \cos\omega_0 t & -\sin\omega_0 t & & & & \\ & \sin\omega_0 t & \cos\omega_0 t & & & & \\ & & & \cos 2\omega_0 t & -\sin 2\omega_0 t & & \\ & & & \sin 2\omega_0 t & \cos 2\omega_0 t & & \\ & & & & & \ddots & \\ & & & & & \cos N\omega_0 t & -\sin N\omega_0 t \\ & & & & & \sin N\omega_0 t & \cos N\omega_0 t \end{bmatrix},$$

$$G(t)=[1\ \cos\omega_0 t\ \sin\omega_0 t\ \cos 2\omega_0 t\ \sin 2\omega_0 t\ \ldots\ \cos N\omega_0 t\ \sin N\omega_0 t].$$

FIG. 4 illustrates the convergence of the thermal distortion estimator given the profile in FIG. 3 and the third-order gain set (3). The convergence of the Fourier coefficient states is shown in FIG. 5.

The antenna distortion estimator in FIG. 1 breaks (6) into two pieces, labeled "Estimator" and "Fourier Series Evaluation". The first updates the Fourier coefficients by integrating the error signal:

$$c(t)=\int_{t_0}^{t} e(\tau)d\tau$$

where $$e(t)=\begin{cases} F(t)L(y_{meas}(t)-y_{ext}(t)) & \text{if beacon available} \\ 0 & \text{if beacon not available} \end{cases}$$

and $y_{meas}(t)$ is the attitude error measurement plus the antenna position command. The second element includes the ground prediction, expressed as a time-varying vector of Fourier coefficients $c_{GP}(t)$. This element is written as:

$$y_{est}(t)=G(t)(c+c_{GP}(t)).$$

While the present invention specifically describes with respect to preferred sequences of process steps and apparatus elements in the preferred embodiments therein, it would be understood that the invention is not limited to only these particular methods and apparatus described in preferred embodiments, nor to the particular process steps, sequences, or process steps, or to the various structures depicted in the drawings. On the contrary, the teaching in this invention is intended to cover all alternatives, modifications and equivalents as may be included within the spirit and scope of the invention defined by the claims which follow.

The scope of the invention is intended to include, for example, variations and alternatives to the disclosed devices and methods for achieving proper pointing of spacecraft antenna. In particular, this invention may also be employed in other modes. For example, the thermal distortion of fixed antenna may be estimated and compensated when the distortion is appropriately sensed, for example, by a sensor system as outlined in U.S. Pat. No. 5,940,034 Dual RF Autotrack Control issued Aug. 17, 1999 to Leung; and then compensated, for example, by appropriately adjusting the spacecraft attitude.

What is claimed is:

1. A thermal distortion estimation system for determining thermal time varying distortion of spacecraft antenna comprising:

a) an error position sensor which determines the time varying distortion of the antenna;

b) a sensor that determines a signal outage for the system; and c) a generated time varying distortion of the system from a previous measurement history.

2. A system for estimating the thermal time varying distortion of spacecraft antenna comprising:

a) a measurement signal outage indicator; and b) a storage device which contains time varying distortion data.

3. The system as defined in claim 2 wherein said outage sensor measures the magnitude of a signal to detect an outage.

4. The system as defined in claim 2 wherein said system may be mathematically expressed as a Fourier series for which the constants are determined by empirical data.

5. The system as defined in claim 4 wherein said empirical data comprises historical thermal distortion data compiled over a period of a year.

6. The system as defined in claim 5 wherein said data is concentrated to more closely correspond in time to the outage.

7. The system as defined in claim 4 wherein said Fourier series may be expressed as:

$$T(t)=A_0(t)+\sum_{n=1}^{N} A_n(t)\cos\omega_0 t+\sum_{n=1}^{N} B_n(t)\sin\omega_0 t.$$

8. A method for estimating the thermal distortion of spacecraft antenna comprising:

a) generating a signal that determines an outage for the system received by the spacecraft and employing a generated time varying distortion of the system from a previous measurement history to predict the error resulting from the thermal distortion.

9. The method as defined in claim 8 wherein said outage signal is received from a tracking receiver which measures the output of the automatic gain control loop.

10. The method as defined in claim 8 wherein said generated time varying distortion is expressed mathematically by a Fourier series.

11. The method of claim 10 wherein said Fourier series may be expressed mathematically as:

$$T(t)=A_0(t)+\sum_{n=1}^{N} A_n(t)\cos\omega_0 t+\sum_{n=1}^{N} B_n(t)\sin\omega_0 t.$$

* * * * *